US005749140A

United States Patent [19]

Polito et al.

[11] Patent Number: 5,749,140

[45] Date of Patent: May 12, 1998

[54] BALLISTIC RESISTANT METAL ARMOR PLATE

[75] Inventors: Anthony J. Polito, Amity; Ronald E. Bailey; William W. Timmons, both of Pittsburgh; Robert H. Bell, Washington, all of Pa.

[73] Assignee: Allegheny Ludlum Corporation, Pittsburgh, Pa.

[21] Appl. No.: 398,934

[22] Filed: Mar. 6, 1995

[51] Int. Cl.[6] ..... F41H 5/04; C22C 38/60

[52] U.S. Cl. ..... 29/527.1; 428/683; 89/36.02

[58] Field of Search ..... 428/683, 684; 228/262; 89/36.02; 29/527.1, 527.7

[56] References Cited

U.S. PATENT DOCUMENTS

| | | | |
|---|---|---|---|
| 1,016,560 | 2/1912 | Giolitti | 428/683 X |
| 1,563,420 | 12/1925 | Johnson | 89/36.02 X |
| 2,562,467 | 7/1951 | Kinnear, Jr. | 428/683 |
| 3,888,637 | 6/1975 | Taguchi et al. | 428/683 X |
| 4,484,959 | 11/1984 | Boucher et al. | 428/683 X |
| 4,645,720 | 2/1987 | Pircher et al. | 428/683 |
| 4,654,720 | 3/1987 | Pircher et al. | 428/683 |

FOREIGN PATENT DOCUMENTS

| | | | |
|---|---|---|---|
| A-41 07 417 A1 | 12/1991 | Germany . | |
| 2 054 110 | 7/1979 | United Kingdom | F41H 5/20 |
| 763442 | 4/1982 | United Kingdom . | |

OTHER PUBLICATIONS

Metal Progress, Oct. 1985, pp. 69–74, C.F. Hickey et al: "Comparing a Split Heat of ESR/VAR 4340 Steel".

"Steels Double Up for Composites", *The Iron Age*, Nov. 16, 1967, pp. 70–72.

"Review of Recent Armor Plate Developments" by Rathbone, *Blast Furnace and Steel Plant*, Jul. 1968, pp. 575–583.

*Primary Examiner*—Kenneth J. Ramsey

*Attorney, Agent, or Firm*—Patrick J. Viccaro; Robert J. Pugh

[57] ABSTRACT

A method of producing steel armor plate having improved resistance to penetration by projectiles. The armor plate provides for intended inclusions, generally elliptically shaped, in the steel oriented substantially parallel to the plate surface. Those inclusions result from at least one element of the steel composition selected from the group of sulfur and oxygen. The steel armor plate may be useful with an increased inclusion level on the front approximately one-half portion of the dual hardness composite steel armor plate so as to spread out the force of the impact over a wider area.

3 Claims, 1 Drawing Sheet

BALLISTIC RESISTANT METAL ARMOR PLATE

BACKGROUND OF THE INVENTION

1. Field of Invention

This invention relates to metal armor plate having improved ballistic defeat capability. More particularly, the invention relates to a method of producing steel armor plate and steel armor plate so-produced having a hard face with intended inclusions in the metal matrix.

2. Background Information

Armor plate has found utility in both civilian and military uses. Historically, armor plate has been produced from various materials, including ceramics, metals, such as steel and aluminum, as well as composites of metals and other materials. Improvements in armor plate have resulted from the desire to provide greater ballistic protection while providing a more light-weight armor plate.

In the 1960s, clad or composite steels were produced and found new uses as a lighter-weight dual hardness composite steel armor. The composites of two steels are used where one is chosen for its hardness and the other for its toughness. The concept of dual hardness composite armor involves the use of a hard front side that breaks up the projectile such as the penetrator of an armor-piercing projectile. The front side is not intended to shatter or spall even though it may be cracked by the ballistic impact because the front side is metallurgically bonded to a tougher crack-arresting rear side. Generally, such armor plate is produced by selecting two steel compositions, producing each of them in a plate product form, and then roll bonding to form the composite dual hardness armor steel plate. See "Steels Double Up for Composites", *The Iron Age*, Nov. 16, 1967, pages 70–72.

Generally, such composite armor plate may range in thickness from 0.040-inch sheet to 3-inch plate. It is known that various steel compositions may be used for the composite materials. Such steels may be referred to by their nominal composition, such as 3 Ni—Mo steel, 5 Ni—Cr—Mo steel, 12 Ni-5 Cr-3 Mo steel, 10 Ni—Cr—Mo—Co steel, as well as an alloy known as HY-130T steel produced by U.S. Steel in the 1960s. See "Review of Recent Armor Plate Developments" by Rathbone, *Blast Furnace and Steel Plant*, Jul. 1968, pages 575–583.

AISI 4340 melted by routine melt methods is frequently used for armor plate applications. AISI 4340 steel is also sometimes used for armor applications when produced through vacuum arc remelting (VAR) or electroslag remelting (ESR). Studies of ESR 4340 using scanning electron microscopy (SEM) showed the presence of calcium aluminate inclusions which were believed to lower fracture toughness. See "Comparing a Split Heat of ESR/VAR 4340 Steel" by Hickey et al, *Metal Progress*, Oct. 1985, pages 69–74.

Conventional wisdom as represented by these publications illustrates that the ballistics defeat capability of metal armor plate is believed to be increased by material with low inclusion content because such material would be tougher and more ductile. There has been a long-standing emphasis in the steel armor plate industry on producing clean steel, i.e., low inclusion content, by ESR or VAR, including by producing low sulfur and/or oxygen contents. This can be illustrated by reference to numerous military specifications for steel armor plate, such as the following:

Mil-A-12560D(MR) (1979)

Mil-A-46173(MR) (1976)

Mil-A-46100D(MR) (1988)

Mil-A-46177B (MR) (1990)

All of these military specifications impose a maximum sulfur requirement of 0.015% or less with no minimum requirement for sulfur. Mil-A-46173 also recites an oxygen requirement of 25 parts per million (ppm) max.

When a projectile strikes armor plate, preferably the projectile will begin to break apart or deform so that its force is diminished. At sufficiently high velocity, a projectile may penetrate the armor plate by pushing a plug out of the back side of the plate. Depending upon the toughness and ductility of the material comprising the armor plate, there may or may not be deformation of the armor plate in the vicinity of the hole. Furthermore, armor plate is expected to meet certain ballistics defeat requirements as defined in a specification at certain material thickness. Frequently, armor plate, when tested by firing projectiles at the plate, may exhibit ballistic results which are marginally passing or marginally failing.

What is needed is an improved steel armor plate having greater stopping power at a given weight and thickness. Conversely, what is needed is an improved steel armor plate for providing the same ballistic defeat capability at a thinner gauge for purposes of providing weight savings.

SUMMARY OF THE INVENTION

The present invention provides a method of producing steel armor plate with improved resistance to penetration by projectiles. The method includes providing an alloy steel armor plate having intended inclusion content with the inclusions oriented substantially parallel to the plate surface. The inclusions result from at least one element of the steel composition selected from the group of sulfur and oxygen, so that the armor plate is characterized by a higher $V_{50}$ protection for a given plate thickness.

In a preferred embodiment of the invention, a composite armor plate is provided by the method of bonding the armor plate to a second armor plate to form a composite clad dual hardness armor plate. The second plate layer has a lower hardness and increased ductility when compared to the first armor plate.

BRIEF DESCRIPTION OF THE DRAWINGS

The FIGURE illustrates a photographic representation of one embodiment of the back side of the composite armor plate of the present invention compared with a prior art composite armor plate after ballistics testing.

DESCRIPTION OF THE PREFERRED EMBODIMENTS

Figure 1:
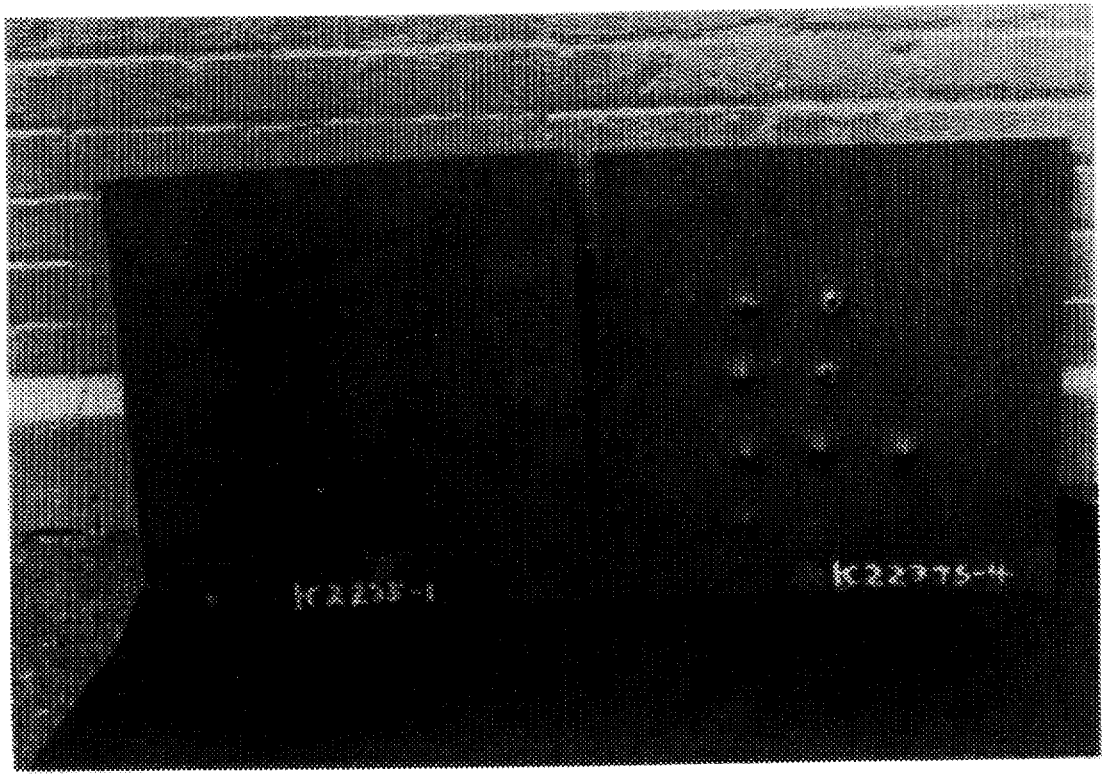

Broadly, in accordance with the present invention, a method is provided for producing a steel armor plate having improved ballistics defeat capability at higher velocities when compared to conventional plates at the same thickness, and having improved ballistics defeat capability at the same velocities but at plate thicknesses less than that of conventional plate materials.

We have found that non-metallic inclusions or particles can be beneficial to improve the ballistics defeat capability of armor plate. The inclusions are oriented parallel to the surface of the armor plate, and preferably, the inclusion shape is generally elliptical rather than rod-like, as a result of the rolling process. This is contrary to the conventional wisdom of the industry which requires that the metal armor plate have a low inclusion content in order to improve the toughness and ductility of the plate material.

Without intending to be bound by theory, it is believed that a steel with higher inclusion content, sometimes referred to as a "dirtier" steel, may promote better ballistic defeat capability by dissipating the energy of the projectile through distribution of the force of the impact over a wider area. Upon impact of the projectile, either the shock wave or cracks in the armor plate will follow the direction of the inclusions parallel to the plate surface, thereby spreading the energy of the impact over a wider area. The inclusions provide a path for the shock wave or cracks to follow which causes the force of the impact to be distributed over a wider area which allows the material to absorb the energy more effectively without penetration of the armor plate by the projectile.

The teachings of the present invention are believed to be useful both in a dual hardness composite steel armor plate, as well as a homogenous steel armor plate. By homogenous plate, it is meant that the armor plate is not a composite of two or more plates, but is a single plate made from one melt composition. It is anticipated that in homogeneous armor plate, the same dual hardness benefits would be realized if the inclusion level were to be increased in approximately one-quarter to three-quarters of the thickness, or more preferably one-half, measured from the front or striking side of the plate.

The armor plate of the present invention may be produced by conventional melting practices such as electroslag remelting (ESR), vacuum arc remelting (VAR), and argon-oxygen decarburization (AOD). What is important, however, is that the steel have sufficient amounts of potential inclusion-forming elements, particularly sulfur and/or oxygen. Higher concentrations of sulfide and oxide inclusions in the solidified steel are required to achieve the desired results. Sulfur content may range from as low as 0.015% up to 0.15%, by weight, and preferably may range from 0.020–0.080%. Oxygen may range from 0.0025 to 0.1000%, by weight, and preferably from 0.0050 to 0.0500%.

Broadly, a suitable plate composition, by weight, may include 0.1–1% carbon, 0–6% nickel, 0–2% molybdenum, 0–3% chromium, 0–2% manganese, 0.1–1% silicon, and the balance iron and residual impurities in addition to the specified amounts of sulfur and/or oxygen in accordance with the present invention. One typical plate composition may include 0.2–0.8% carbon, 2–4% nickel, 0.1–0.6% molybdenum, 0.3–1.2% chromium, less than 1% manganese and less than 0.5% silicon, and the balance iron and residual impurities in addition to the specified amounts of sulfur and/or oxygen in accordance with the present invention.

In all other respects, the steel composition of the armor plate may be conventional alloy steel typically used for armor plate. Such steels may contain specified amounts of nickel, chromium, molybdenum, cobalt, or other elements as is conventional. It is believed that the teachings of the present invention for providing higher inclusion content to benefit ballistic resistance is not necessarily dependent upon the overall composition of the steel and, therefore, is useful in many steel armor plate alloys.

Many of the steps in the method of producing the steel armor plate of the present invention are conventional. The method would include melting the appropriate steel composition, casting into ingot or slabs, and hot rolling to an intermediate slab thickness. When producing a composite plate, each steel composition would be melted and hot rolled to an intermediate slab thickness. Thereafter, the composite would be produced by grinding and cleaning the mating surfaces of the two slabs, peripheral welding to form packs on the front and rear slabs, possibly but not necessarily, evacuating and hermetically sealing the slabs, thereafter roll-bonding to the desired plate thickness and subsequently heat treating by austenitizing, quenching, and tempering as necessary. What is necessary in the method of the present invention is that the steel composition provides sufficient quantities of sulfur and/or oxygen to provide a necessary inclusion content so that when rolled to plate thickness, the inclusions will be substantially parallel to the plate surface and generally elliptical rather than rod-like in shape.

In order to better understand the present invention, the following Example is presented.

EXAMPLE

Two dual hardness composite steel armor plates were produced having a front side of different compositions to illustrate the present invention. The back side of each composite had the same nominal composition. The actual iron-based compositions of the plates used for the front sides and the back sides of the composites are shown in the following Table I.

TABLE I

| Composite Plate No. | Side | Heat No. | C | Mn | P | S | Si | Ni | Cr | Mo |
|---|---|---|---|---|---|---|---|---|---|---|
| K2237S (Invention) | Front | 1C217 | .60 | .45 | .016 | .033 | .32 | 3.06 | .45 | .40 |
| | Back | 1C218 | .28 | .47 | .014 | .003 | .25 | 3.34 | .37 | .39 |
| K2235 | Front | 3B736 | .61 | .52 | .012 | .004 | .31 | 3.35 | .17 | .40 |
| | Back | 2B603 | .29 | .48 | .015 | .001 | .28 | 3.35 | .10 | .40 |

All four Heats were produced in a conventional manner by melting using an electric arc furnace followed by argon-oxygen decarburization, casting into ingots, hot working, and forming a composite. Several test panels of a dual hardness steel armor plate bearing Composite Plate No. K2237S were produced using Heat 1C217 as the front side and Heat 1C218 as the back side. Several test panels of a dual hardness plate bearing Composite Plate No. K2235 were produced using Heat No. 3B736 as the front size and Heat No. 2B603 as the back side.

The ballistic resistance of test panels from Heats K2235 and K2237S were tested. The results of the testing are shown in the following Table II. Both test panels shown had an average thickness of 0.273 inch and were tested with a projectile of 5.56 mm M193 ball at an obliquity of 0°.

TABLE II

| Composite Test Panel | $V_{50}$ (fps) | High Partial (fps) | Low Complete (fps) |
|---|---|---|---|
| K2237S-4 (invention) | 3629 | 3608 | 3644 |
| K2235-1 | 3479 | 3488 | 3472 |

"High Partial" means the highest velocity (feet per second) of a projectile that did not penetrate the test panel.
"Low Complete" means the lowest velocity (fps) of a projectile that penetrated the test panel.
"$V_{50}$" ballistic protection limit is defined as the projectile velocity (fps) for which the probability of penetration is 50%.

The dual hardness armor plate of the present invention is clearly shown to have an improved ballistics defeat capability. The dual hardness armor plate of the present invention surpasses an applicable ballistics specification by either a larger margin or passes the specification by a comfortable margin as compared with standard material which may either pass by a smaller margin or fail the specification requirement.

As shown by the data in Table II, the steel armor plate of the present invention demonstrated superior results in the V-50 test by exceeding the conventional plate by 150 feet per second. The plate of the present invention also exhibited superior results in the High Partial and Low Complete measurements by 120 fps and 172 fps, respectively.

The FIGURE is a photographic representation of the rear face of Test Panels K2237S and K2235-1 shown in Table II. The concept of providing an impact surface which would spread out the force of a projectile over a wider area using inclusions and facilitating crack propagation was demonstrated. The Test Panels tested exhibited outstanding ballistics for the composite steel armor plate of the present invention (K2237S-4) and showed pronounced bulges on the softer back side as compared to the bulges of the conventional dual hardness armor plate. The more pronounced bulges clearly show that the projectile force was more widely distributed across the impact face.

As was an objective of the present invention, a method of producing a steel armor plate with improved resistance to penetration by projectiles and an improved steel armor plate were made. The novel idea of using inclusions based on increasing the amount of sulfur and/or oxygen in the steel was confirmed. Although demonstrated on composite steel armor plate, the present invention is applicable to homogeneous armor plate wherein the inclusion level is increased on one surface (the striking surface) of the plate, preferably within about three-quarters to one-quarter of the plate thickness nearest that one surface.

While preferred embodiments of the present invention have been described and shown, it will be clear to those skilled in the art that modifications may be made without departing from the scope of the invention.

What is claimed is:

1. The method of producing steel armor plate with improved resistance to penetration by projectiles, the method comprising:

providing an alloy steel armor plate having inclusions oriented substantially parallel to the plate surface, the plate composition comprises, by weight percentage, 0.2–0.8 carbon, 2–4 nickel, 0.1–0.6 molybdenum, 0.3–1.2 chromium, less than 1 manganese, less than 0.5 silicon, the balance iron and residual impurities, said inclusions resulting from at least one element of the steel composition, by weight percentage, selected from the group of sulfur and oxygen, wherein sulfur ranges from 0.015 to 0.150 and oxygen from 0.0025 to 0.1000, the armor plate characterized by a higher V50 protection for a given plate thickness.

2. The method of producing steel armor plate with improved resistance to penetration by projectiles, the method comprising:

providing an alloy steel armor plate having inclusions oriented substantially parallel to the plate surface, providing the plate with the inclusions concentrated in about one-quarter to three-quarters of the plate thickness to provide a mechanism whereby the force of the impact is spread out over a wider area, said inclusions resulting from at least one element of the steel composition by weight percentage, selected from the group of sulfur and oxygen, wherein sulfur ranges from 0.015 to 0.150 and oxygen from 0.0025 to 0.1000, the armor plate characterized by a higher $V_{50}$ protection for a given plate thickness.

3. The method of producing steel armor plate with higher $V_{50}$ protection from penetrating projectiles, the method comprising:

melting an alloy steel, producing a plate from the steel, so that the steel exhibits intended inclusions within the steel oriented substantially parallel to the plate surface, the inclusions being generally elliptical in shape, providing the plate with the inclusions concentrated in about one-half the plate thickness to provide a mechanism whereby the force of the impact is spread out over a wider area, the steel plate composition comprises, by weight percentage, 0.1–1 carbon, 0–6 nickel, 0–2 molybdenum, 0–3 chromium, 0–2 manganese, 0.1–1 silicon, and at least one element selected from the group of 0.015–0.150 sulfur and 0.0025–0.1000 oxygen, the balance iron and residual impurities, the inclusions resulting from the sulfur and/or oxygen content.

* * * * *